United States Patent [19]

Daenen

[11] 4,144,896

[45] Mar. 20, 1979

[54] METHOD AND APPARATUS FOR JOINING STRIPS CUT FROM TOBACCO LEAVES TOGETHER TO FORM A RIBBON

[75] Inventor: Bernardus Daenen, Uitgeest, Netherlands

[73] Assignee: Van Der Molen Machinefabriek B. V., Netherlands

[21] Appl. No.: 663,707

[22] Filed: Mar. 4, 1976

[30] Foreign Application Priority Data

Mar. 10, 1975 [NL] Netherlands ..... 7502839

[51] Int. Cl.[2] ..... A24B 3/00

[52] U.S. Cl. ..... 131/149; 270/58

[58] Field of Search ..... 131/15, 58, 59, 147 R, 131/148, 149; 156/356, 360, 502, 507, 558; 270/58, 59; 271/202, 8 R

[56] References Cited

U.S. PATENT DOCUMENTS

| | | | |
|---|---|---|---|
| 2,816,755 | 12/1957 | Dusenbury et al. | 156/558 |
| 3,542,036 | 11/1970 | Hooper et al. | 131/149 X |
| 3,542,038 | 11/1970 | Hooper et al. | 131/149 |
| 3,744,498 | 7/1973 | Imbert | 131/149 |
| 3,874,648 | 4/1975 | King et al. | 270/58 |

FOREIGN PATENT DOCUMENTS

| | | | |
|---|---|---|---|
| 1148437 | 5/1963 | Fed. Rep. of Germany | 271/202 |
| 1532094 | 1/1970 | Fed. Rep. of Germany | 131/149 |

*Primary Examiner*—Robert W. Michell
*Assistant Examiner*—V. Millin

[57] ABSTRACT

Method and apparatus for joining together substantially rectangular random length strips cut from tobacco leaves to form a continuous band on an endless tape.

15 Claims, 6 Drawing Figures

Figures 1, 2, 3, 4:
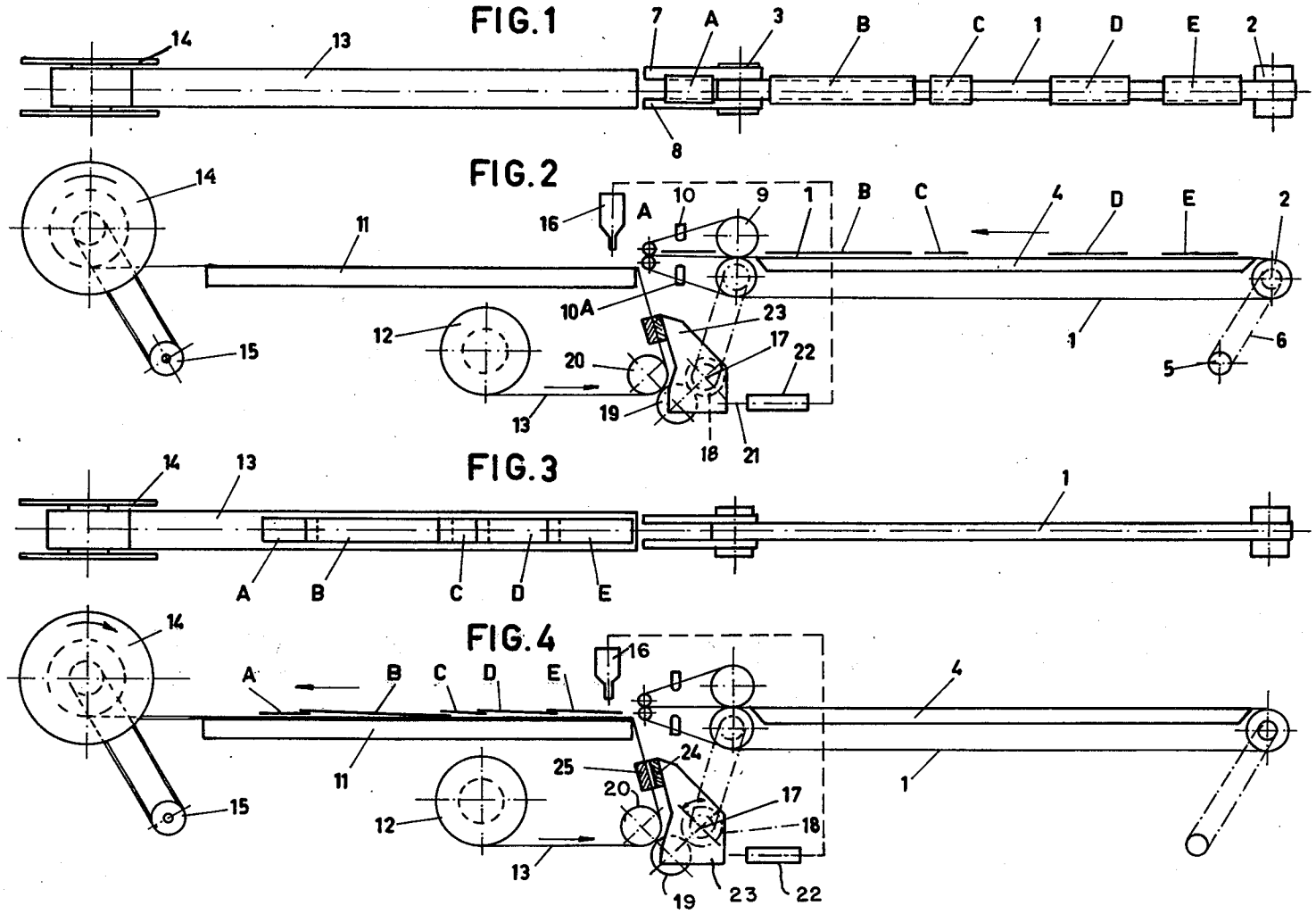

METHOD AND APPARATUS FOR JOINING STRIPS CUT FROM TOBACCO LEAVES TOGETHER TO FORM A RIBBON

The present invention relates to apparatus for joining strips cut from tobacco leaves to form a ribbon or band thereof for use in cigar making machines.

Suggestions have already been made to join together mainly rectangular strips cut from tobacco leaves to form greater lengths. These lengths have, so far, practically always been processed directly into wrapper and fed to the cigar making machine. The subject of storage for a longer period of time, pre-packing and transport over long distances was out of the question.

It is the aim of the invention to process cut tobacco strips in such a manner that a practically endless band or endless ribbon is produced from it, which band can be stored, if necessary for a long period of time, in a form suitable for this purpose and which can, if desired, be transported in that form over long distances.

The invention furnishes in particular a device suitable for this purpose, which consists of a conveying belt for the strips, an intermediate conveyor connected to the latter and fitted with means to determine the lengths of the strips, to which conveyor a second conveyor is connected, which consists of a support over which a carrier of synthetic material reeling off a reel can move, which carrier can be reeled-up on a reel again, at the beginning of the second conveyor means have been provided for the feeding of a paste or similar adhesive, while further means have been provided which interrupt periodically the constant feed of the carrier tape in accordance with the length of a strip of tobacco to be conveyed.

With the new device bands of tobacco can be reeled-up on a reel or such like in very great length. The compact mass constitutes a guarantee against drying up, while the reel is an easy conveying unit, which can also be stored as such in a storehouse for a longer period of time.

With further processing, for instance in the cigar making machine, the carrier tape can be recovered again and (if necessary, after cleaning) be used anew when reeling-up tobacco bands to be produced, as described before.

The intermediate conveyor preferably consists of a set of parallel running belts positioned at some distance from each other, the driving mechanism of which is coupled to the drive of the conveyor for the cut tobacco strips, which drive is also coupled to the drive for the carrier tape of synthetic material, while a light-sensitive cell system can measure the strips placed by the intermediate conveyor, which measuring data serve to command the intermittent movement of the carrier tape.

Preferably the driving mechanism for the carrier tape is formed by a tumbler or pivotal bracket the shaft of which is coupled to a drive for the conveyor for the tobacco strips, which shaft has a roller which is in contact with a roller projecting outside the tumbler, which latter roller can co-act with a roller over which the carrier tape is led, while the tumbler has on the other side a clamping member, which can co-act with a counter-organ over which the carrier tape is led, whereby the action of the tumbler is obtained by a cylinder-piston combination which is commanded by the light-sensitive cell system of the intermediate conveyor.

For the purpose of reeling-up the carrier tape with the pasted tobacco strips a reel or similar spool is provided which is driven via a slip coupling.

The invention further relates to a winding unit or a similar conveying unit on which a tobacco band is reeled while a synthetic material carrier tape is inserted in between. Such conveying unit can, as has been mentioned before, be stored for a longer period of time and it is not necessary either that this band is fed immediately to a cigar making machine.

The invention is further explained with the help of the drawing. In the drawing:

FIG. 1 shows schematically a top view and

Figure 5:
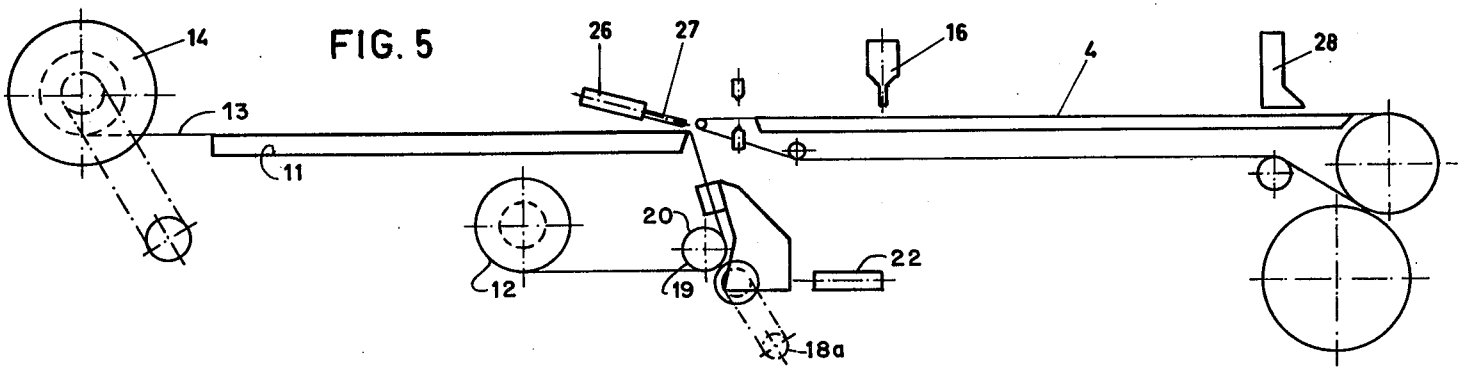
Figure 6:
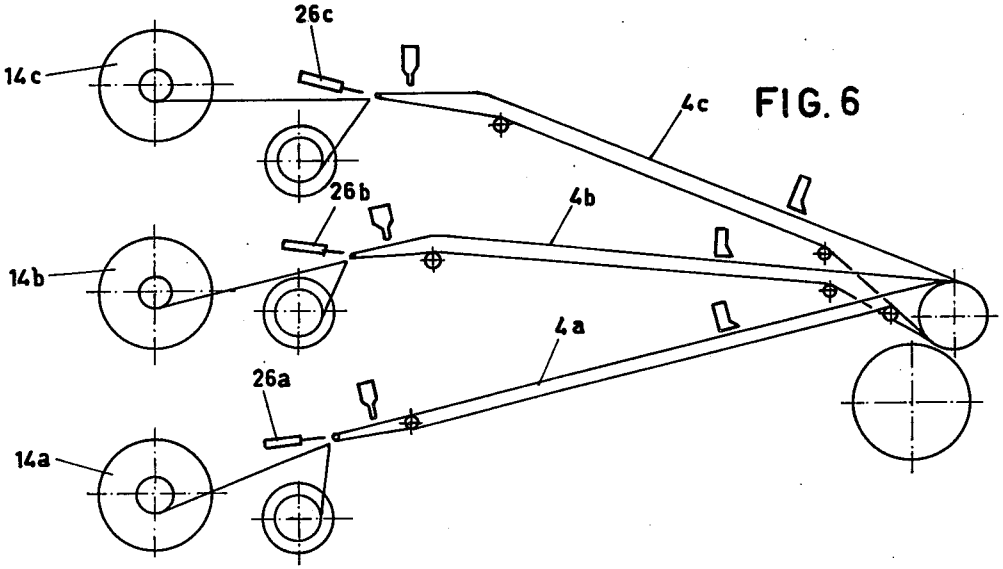

FIG. 2 a side elevation of a device of the invention at a certain process-phase;

FIG. 3 and FIG. 4 respectively show a top- and side elevation of the same machine in a different process-phase;

FIG. 5 shows a side elevation of a somewhat different embodiment of the invention and FIG. 6 shows schematically a general plan of a plural construction.

The device of the invention substantially consists of a conveyor comprising an endless belt 1 which is led over the rollers 2 and 3 of which belt 1 the upper run is led over a support 4. The direction of motion of the belt 1 is indicated by the arrow. The driving roller or similar member which may be coupled to a motor is indicated by 5, which roller is connected as a drive to the shaft of roller 2 by an endless belt 6.

Connected to conveyor 1 is an intermediate conveyor comprising two parallel running belts 7 and 8 positioned at some distance laterally from each other, the double form of execution of which appears from FIGS. 2 and 4. The driving of the intermediate conveyor is effected via roller 3 which co-acts with roller 9. Between the belts 7 and 8 of the intermediate conveyor there is provided a set of measuring cells 10 and 10A which preferably may be executed as light-sensitive units.

Adjacent to and somewhat below the intermediate conveyor there is connected a second conveyor which consists of a carrier 11 over which a synthetic material tape 13 is supported. The tape 13 is unwound from a reel 12 and can be reeled onto a reel 14 which is driven by a shaft or roller 15. This drive functions, as will be described, through a slip coupling.

At the beginning point or rear end of the second conveyor a dispensing device 16 has been provided for the purpose of applying paste or such like adhesive.

The synthetic material carrier tape 13 is guided by a pivotal tumbler bracket 23 the swivelling point of which is a shaft indicated by 17. This point also constitutes the geometrical axis around which a roller 18 is rotatably mounted and which roller 18 is coupled to the roller 3 of the conveyor 1. The roller 18 drives the roller 19 which in turn leans against the synthetic material carrier tape 13 which in turn is led again over a roller 20. Operation of the tumbler is effected by a pneumatic piston-cylinder-combination 21–22 control of which is effected by the measuring system 10-10A.

The tumbler which is indicated as a whole by 23, has at the top end a clamp 24 which co-acts with a fixed clamp 25. The synthetic material carrier tape 13 is led between the clamps 24 and 25.

The device functions as follows.

Substantially rectangular strips are cut from tobacco leaf in the known manner, which strips or bands are then checked for imperfections and placed on the first conveyor. Damaged parts and parts which show holes are cut off and removed and the perfect tobacco strips are fed to the conveyor 1. While the strips have different lengths, and the distances between them are different, the feed can, however, be continuous and in the initial phase one arrives at the situation as drawn in FIGS. 1 and 2 for the tobacco bands A, B, C, D and E.

At a given moment one of the strips, in this case A, lands on the intermediate conveyor and during conveyance the length is measured by the light-sensitive system 10–11. The measured length represents a measure for the command of the tumbler 23. Namely, when the tobacco strip A lands on the synthetic material carrier tape 13, the cylinder-piston-combination 21/22 is commanded by the system 10-10A, to rotate the tumbler 23 whereby the drive roller 19 presses against the carrier tape 13, which is led around the roller 20. When the tumbler 23 tips so that rollers 19 and 20 engage, the co-action between the clamps 24 and 25 is interrupted and the carrier tape 13 freely passes in between being fed to the conveyor 11. As soon as the tobacco strip A is completely over the support 11 on the carrier tape, the tumbler 23 is turned back and the active connection between rollers 19 and 20 is interrupted. The clamps 24 and 25 simultaneously come into action arresting the carrier tape 13.

Since the reel 14 is driven via a slip coupling it is possible without any difficulty to interrupt the transport of the carrier tape 13. Thus, as soon as the clamps 24 and 25 release the carrier tape 13, it is driven and an indisturbed reeling-up of the reel 14 takes place. On the other hand, as soon as the clamps 24 and 25 arrest the carrier tape 13, the slip coupling is actuated and no further reeling-up takes place. When the synthetic material carrier tape 13 is arrested, the tail end of the tobacco strip stops beneath the dispensing means 16 and a small amount of paste or a similar adhesive is applied to the tobacco band, whereupon the next succeeding strip is fed to the conveyor 11 to overlap the preceding strip. In this sequential movement a continuous band is made. Since there is a difference in height between the intermediate conveyor and the second conveyor the tobacco strips A/E will overlap. After the last strip E has passed the intermediate conveyor the situation depicted in FIGS. 3 and 4 arises. The overlapping of the strips clearly stands out, though here with the last strip the actual pasting does not take place. The carrier tape with the tobacco strips A/E are reeled onto reel 14. Since the tobacco is to be processed at a certain degree of moisture, a rather compact mass will, after a reel has been fully wound, result which will not easily dry up. A fully wound reel can as such be removed from the reeling shaft and may be stored as a conveyor unit. Consequently, it is not necessary to use the material immediately.

When later-on the material is to be used in a cigar making machine the wrapper can be cut from the tobacco band and can subsequently be wrapped around the cigars. Thereby the synthetic material carrier tape 13 can be recovered and can, if necessary after cleaning, be used anew, taking the place of the reel 12 in the device. The device depicted in FIG. 5 substantially corresponds with the one of FIGS. 1–4. The difference here is that between the feeder belt 4 and the guiding member 11 for the carrier tape 13 there is provided a transmission mechanism for the tobacco strips. This consists of a cylinder 26 and a reciprocating piston with rod 27 which has been constructed in the shape of a fork. The tobacco strips are taken from the belt 4 by the forked rod and subsequently the rod is very rapidly retracted at a speed greater than they are fed on the first conveyor, whereby the strip concerned is placed on top of the strips joined on the tape to form a band with those already present on the carrier tape 13 and is pasted onto the end of the tobacco band.

28 indicates a suction cap through which the tobacco waste is sucked off.

FIG. 6 shows a number of devices of FIG. 5 placed adjacent each other. This arrangement is necessary because the width of the carrier tape is larger than that of the tobacco band or the strips from which the band is composed.

The feeder belts **4*a*, 4*b* and 4*c* are consequently not situated in the same horizontal plane. The conveying mechanisms have been indicated in the Figure by 26*a*, 26*b* and 26*c*. The finished bands are wound up to form a roll at 14*a*, 14*b* and 14*c***.

I claim:

1. Apparatus for joining random length strips of tobacco leaves into a continuous band comprising first and second axially aligned conveyors, said first conveyor being movable to cause the transfer of successively spaced strips of tobacco to said second conveyor, said second conveyor including an endless tape arranged to receive said tobacco strips and means located at the forward end of said second conveyor for pulling said tape at a constant speed, dispensing means for applying an adhesive to the trailing edge of the strips of tobacco; means for sensing the length of the respective random length strips of tobacco on said first conveyor, and means responsive to said sensing means for periodically interrupting the movement of said tape corresponding to the length of the tobacco strip sensed for a period sufficient to cause the first conveyor to move each succeeding tobacco strip a distance wherein a narrow marginal portion of the leading edge overlaps a narrow marginal portion of the trailing edge of the preceding strip on being transferred to said second conveyor to thereby form a continuous band of substantial single layer on said endless tape.

2. The apparatus according to claim 1 wherein said tape is formed of synthetic material.

3. The apparatus according to claim 1 including an intermediate conveyor interposed between said first and second conveyors movable conjointly with said first conveyor, said sensing means being arranged in association with the intermediate conveyor.

4. The apparatus according to claim 3 wherein said intermediate conveyor comprises a set of parallel equidistantly spaced movable belts, and means for conjointly driving said belts, and said first conveyor.

5. The apparatus according to claim 1 wherein said means for pulling said tape comprises a reel upon which said tape may be wound and means for rotating said reel about its central axis.

6. The apparatus according to claim 5 wherein the means for winding said tape comprises a shaft coupled to the associated drive means via a slip clutch coupling.

7. The apparatus according to claim 5 wherein said tape is fed from a storage reel and includes means for pulling said tape from said storage reel to feed the same.

8. The apparatus according to claim 7 wherein said means for feeding said tape is arranged between said first and second conveyors and comprises a pair of engaging rollers between which said tape passes, one of said engaging rollers being carried on a pivotal tumbler bracket, said bracket being mounted on a rotatable shaft coupled to the drive means for said conveyor, a drive roller fixedly mounted on said shaft for conjoint rotation therewith, said drive roller engaging said one of said engaging rollers carried by said tumbler bracket, said tumbler bracket having brake means engageable with said tape, and motor means responsive to said sensing means for pivoting said tumbler bracket about said shaft placing said brake means and said drive roller alternately in respective engagement with said tape and the associated engaging rollers.

9. The apparatus according to claim 8 wherein said motor means comprises a piston and cylinder.

10. The apparatus according to claim 5 including a plurality of first conveyors arranged adjacent each other, each of said first conveyors being entrained about a common support roller at their trailing end and means for feeding said tobacco strips thereto and about separate support rollers at their forward ends, and including a plurality of second conveyors respectively associated with one of said first conveyors.

11. The apparatus according to claim 1 including means for transferring said strips from said first conveyor to said second conveyor comprising a reciprocating piston having a forked end adapted to engage said tobacco strip, said piston being arranged at an angle to said direction of movement of said conveyors and being movable toward and away from said first conveyor at a speed greater than said first conveyor to carry said tobacco strips to said tape.

12. Apparatus according to claim 1, including dispensing means for applying adhesive to the trailing edge of the strips of tobacco prior to overlapping of said strips.

13. Apparatus for joining random length strips of tobacco leaves into a continuous band comprising first and second axially aligned conveyors, said first conveyor being movable to cause the transfer of successively spaced strips of tobacco to said second conveyor, said second conveyor including an endless tape arranged to receive said tobacco strips and means located at the forward end of said second conveyor for pulling said tape at a constant speed, means for sensing the length of the respective random length strips of tobacco on said first conveyor, and means automatically responsive to said sensing means for periodically interrupting the movement of said tape corresponding to the length of the tobacco strip sensed for a period sufficient to cause the first conveyor to move each succeeding tobacco strip a distance wherein a narrow marginal portion of the leading edge overlaps a narrow marginal portion of the trailing edge of the preceding strip on being transferred to said second conveyor to thereby form a continuous band of substantial single layer on said endless tape.

14. The apparatus according to claim 13, wherein said adhesive dispensing means is arranged in association with said second conveyor and is adapted to dispense the adhesive during the interruption in the movement of the tape.

15. The apparatus according to claim 13, wherein said adhesive dispensing means is arranged in association with said first conveyor and is adapted to dispense the adhesive during the movement of said first conveyor.

* * * * *